US006435125B2

(12) United States Patent
Mears

(10) Patent No.: US 6,435,125 B2
(45) Date of Patent: Aug. 20, 2002

(54) FLOAT SWITCH ACTIVATION ASSEMBLY

(75) Inventor: Arthur W. Mears, Longmont, CO (US)

(73) Assignee: Float Rail, Inc., Boulder, CO (US)

( * ) Notice: Subject to any disclaimer, the term of this patent is extended or adjusted under 35 U.S.C. 154(b) by 0 days.

(21) Appl. No.: 09/864,642

(22) Filed: May 24, 2001

Related U.S. Application Data

(63) Continuation of application No. 09/832,774, filed on Apr. 10, 2001.

(60) Provisional application No. 60/207,996, filed on May 26, 2000.

(51) Int. Cl.[7] ..... B63B 43/02

(52) U.S. Cl. ..... 114/360; 114/68; 114/345

(58) Field of Search ..... 114/68, 69, 123, 114/219, 345, 348, 360

(56) References Cited

U.S. PATENT DOCUMENTS

| | | | | | |
|---|---|---|---|---|---|
| 151,400 | A | | 5/1874 | Keeler et al. | |
| 980,790 | A | | 1/1911 | Johnson | |
| 1,038,928 | A | | 9/1912 | Menzel | |
| 1,133,629 | A | * | 3/1915 | Foster | 114/68 |
| 1,220,876 | A | | 3/1917 | Moore | |
| 1,249,633 | A | | 12/1917 | Jelercic | |
| 1,622,508 | A | | 3/1927 | Harper | |
| 2,924,192 | A | * | 2/1960 | Salvage | 114/68 |
| 3,092,853 | A | * | 6/1963 | Owen | 114/68 |
| 3,822,662 | A | * | 7/1974 | Morita et al. | 114/68 |
| 4,458,618 | A | | 7/1984 | Tuffier | |
| 4,495,880 | A | | 1/1985 | Maniscalco et al. | |
| 4,667,618 | A | | 5/1987 | Cigognetti | |
| 4,817,555 | A | | 4/1989 | Meinen | |
| 4,864,961 | A | | 9/1989 | Slonski | |
| 4,867,094 | A | | 9/1989 | Binks | |
| 4,996,936 | A | | 3/1991 | Brundritt | |
| 5,215,031 | A | | 6/1993 | Inman et al. | |
| 5,357,888 | A | | 10/1994 | Insinna | |

FOREIGN PATENT DOCUMENTS

| | | |
|---|---|---|
| DE | 3530618 A1 | 3/1987 |

* cited by examiner

*Primary Examiner*—S. Joseph Morano
*Assistant Examiner*—Lars A. Olson
(74) *Attorney, Agent, or Firm*—Emery L. Tracy

(57) ABSTRACT

A switch system for automatically activating a mechanism such as a gas or fluid supply, an electrical switch, or chemical process is provided. The switch system comprises a float housing and a float slidable within the float housing with the float slidable from a first position to a second position. An activation trigger extends through the float housing with the activation trigger having a first trigger end and a second trigger end, the first trigger end contacting the float. A valve activates the mechanism with the valve connected to the second trigger end wherein upon movement of the float from the first position to the second position, the second trigger end activating the mechanism.

20 Claims, 16 Drawing Sheets

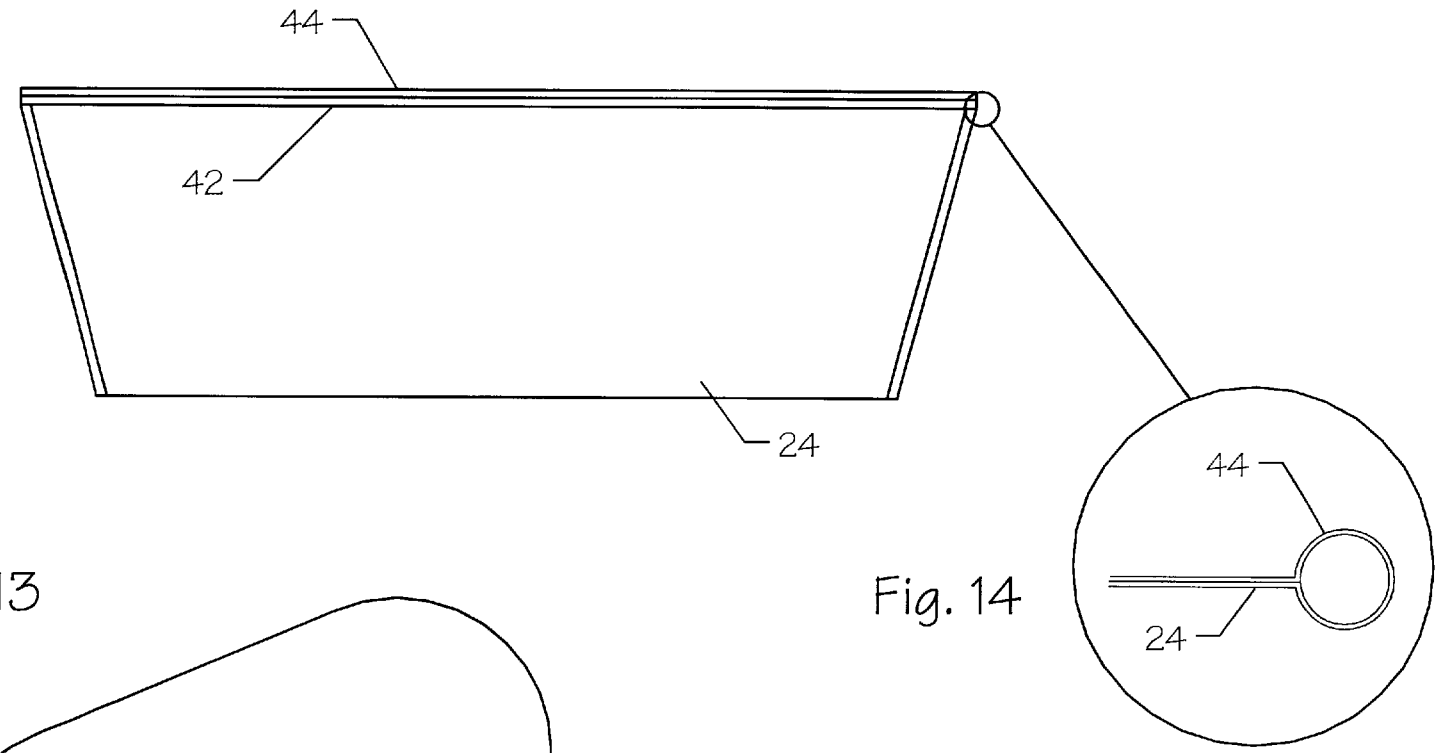
Fig. 12
Fig. 14
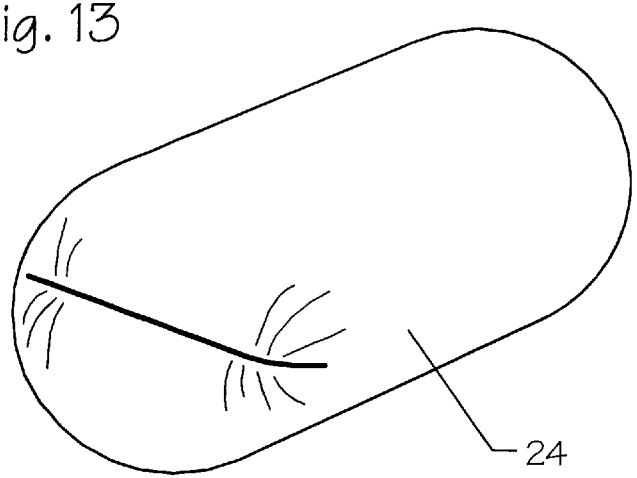
Fig. 13

FLOAT SWITCH ACTIVATION ASSEMBLY

The present application is a continuation of pending provisional patent application Ser. No. 60/207,996, filed on May 26, 2000, entitled "Automatic Inflating Boat Flotation Device" and pending patent application Ser. No. 09/832,774, filed Apr. 10, 2001, entitled" Automatic Boat Flotation Device".

BACKGROUND OF THE INVENTION

1. Field of the Invention

The present invention relates to a float switch activation assembly and, more particularly, it relates to a float switch activation assembly which is capable of inflating a watercraft flotation device that inhibits a watercraft from sinking. The flotation device automatically inflates when a predetermined amount of water enters the hold of the watercraft and activates the float switch activation assembly.

2. Description of the Prior Art

Boating is both a popular pastime and a vital commercial activity in much of the world today. A boat is often a substantial investment for the owner. In the case of commercial boats, the boat is often the livelihood of the owner of the boat. As a general concept, boats sink when the hull of the boat takes on water and the boat loses its buoyancy. This can happen if the hull is breached due to a collision with some object or in heavy waves if the boat is swamped.

Flotation devices and the switches to activate the flotation devices have not been able to always maintain the boats in a floating position. Many times, these switches were required to be manually operated which would allow a boat to sink when the boat was vacant. Other switches were generally unreliable in that premature flotation of the flotation devices or failure to activate the flotation devices would occur thereby causing inconvenience, and possibly injury, to the boat owner.

The primary aspect of the present invention is to provide a float switch activation assembly which is capable of inflating a watercraft flotation device that inhibits a watercraft from sinking after water has partially filled the hull of the boat and for any other switch or activation based on change in level of fluid or gas.

SUMMARY

The present invention is a float switch assembly for activating a gas supply for inflating a flotation device mounted on a watercraft. The flotation device maintains the watercraft in a floating condition. The float switch assembly comprises a hollow float housing having a first end and a second end and at least one aperture formed in the first end of the float housing. A float body is movable within the float housing upon a predetermined amount of water entering the float housing through the aperture. A trigger mechanism contacts the float body with the trigger mechanism having an attachment end extending through a slot formed in the float housing. A pivot assembly pivotally is connected to the attachment end of the trigger mechanism. An activatable valve mechanism is connected to the gas supply with the valve mechanism releasably connected to the attachment end of the trigger mechanism and movable from a closed position to an open position wherein upon movement of the float body within the float housing, the trigger mechanism pivots about the pivot assembly thereby disconnecting the attachment end of the trigger mechanism from the valve mechanism and moving the valve mechanism into the open position such that gas flows from the gas supply to the flotation device.

The present invention additionally includes a switch system for automatically activating a gas supply. The switch system comprises a float housing and a float slidable within the float housing with the float slidable from a first position to a second position. An activation trigger extends through the float housing with the activation trigger having a first trigger end and a second trigger end, the first trigger end contacting the float. A valve activates the gas supply with the valve connected to the second trigger end wherein upon movement of the float from the first position to the second position. the second trigger end activating the valve to allow gas flow from the gas supply.

The invention further includes a method for activating a gas flow between a gas supply and a flotation device. The method comprises providing a hollow float housing, positioning a float body within the float housing, providing a valve mechanism between the gas supply and the flotation device, pivotally connecting a trigger mechanism between the float body and the valve mechanism, sliding the float body within the float housing upon the occurrence of a predetermined event, pivotally rotating the trigger mechanism, and activating the gas flow between the gas supply and the flotation device.

The present invention is further applicable to any situation where a valve or switch is to be activated by the increase in the level of fluid or gas. While the valve or switch is preferably mechanical, it can also be electrical and/or chemical.

Other aspects of this invention will appear from the following description and appended claims, reference being made to the accompanying drawings forrning a part of this specification wherein like reference characters designate corresponding parts in the several views.

BRIEF DESCRIPTION OF THE DRAWINGS

FIG. 12 is top perspective view illustrating the flotation bladder in a deflated condition;

FIG. 13 is a perspective view illustrating the flotation bladder in an inflated condition;

FIG. 14 is a sectional view illustrating the attachment edge of the flotation bladder taken along line A—A of FIG. 12;

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENTS

Figure 1:
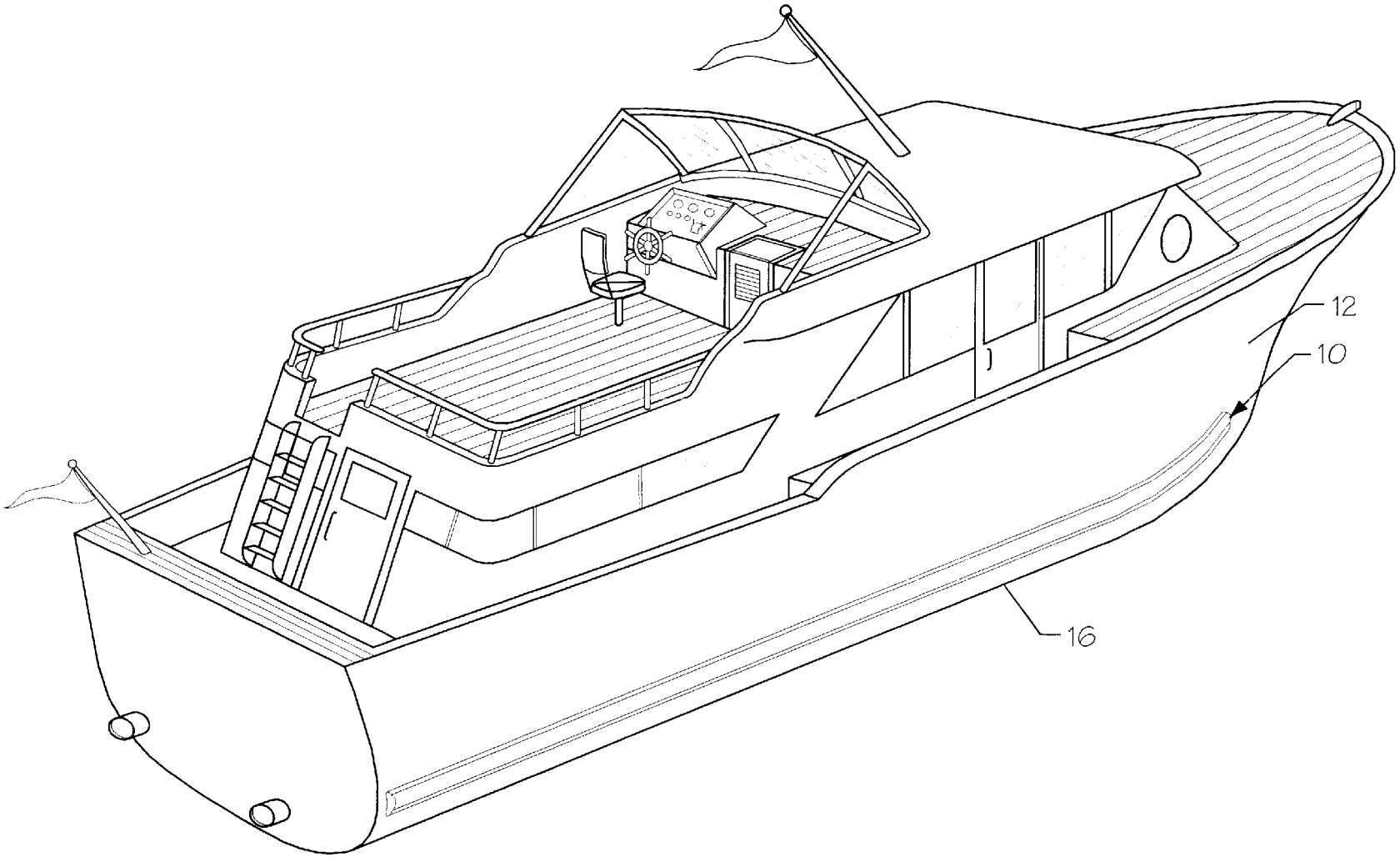
FIG. 1 is a perspective view illustrating a flotation device for inflation by a float switch activation assembly, constructed in accordance with the present invention, with the flotation device being mounted on a hull of a watercraft having a boat rail.
Figure 2:
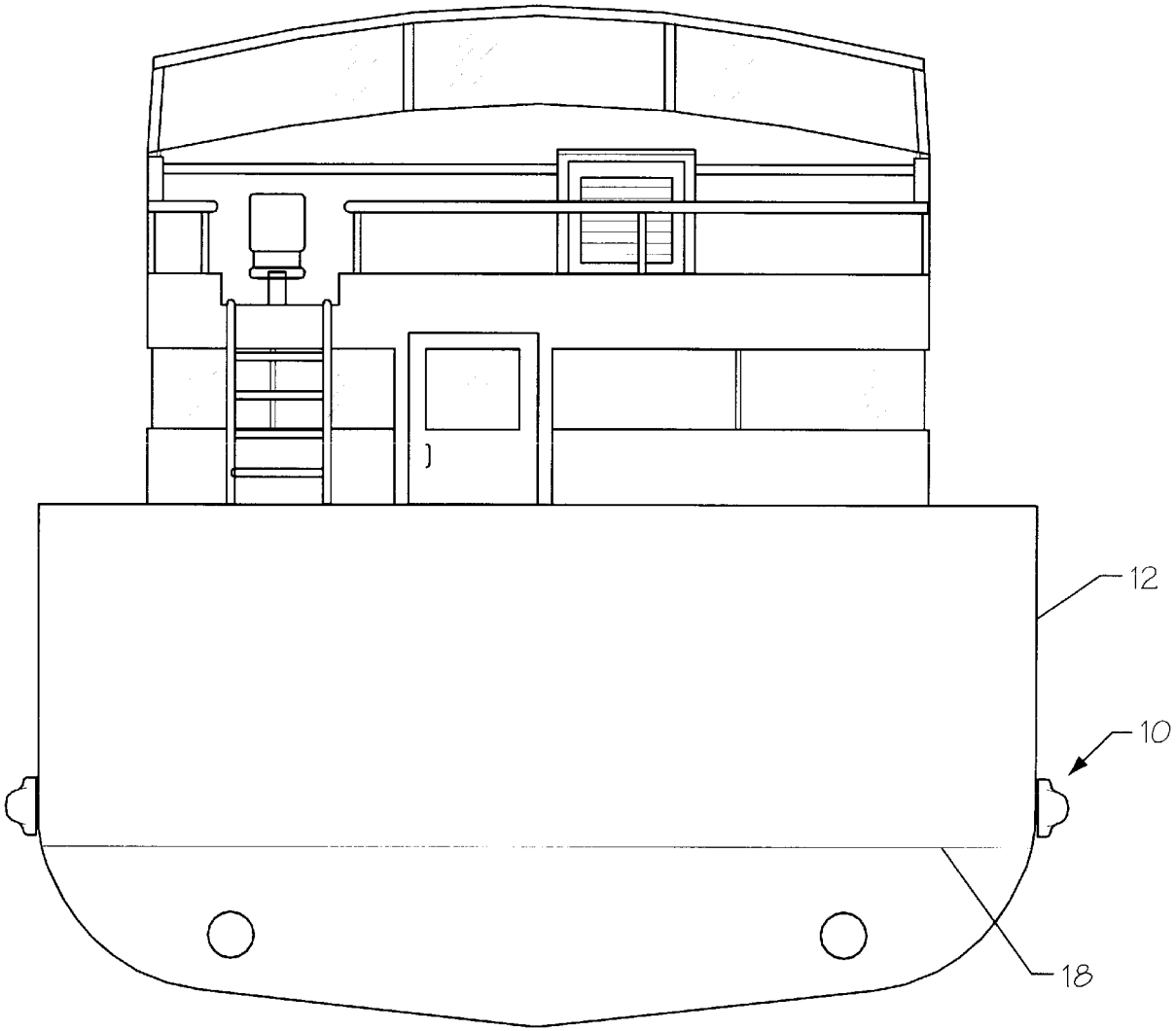
FIG. 2 is a rear view illustrating the flotation device, constructed in accordance with the present invention, with the flotation device mounted to the hull adjacent the waterline.
Figure 4:
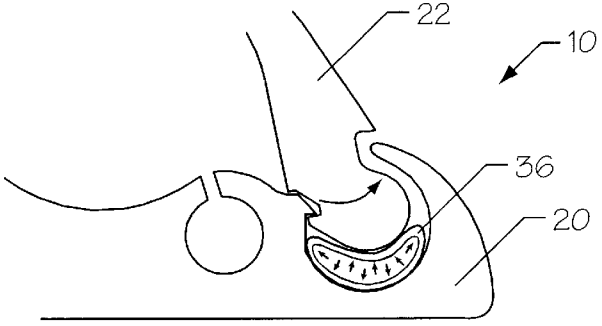
FIG. 4 is a sectional view illustrating the flotation device of FIG. 3 with the inflatable tubing being partially inflated.
Figure 6:
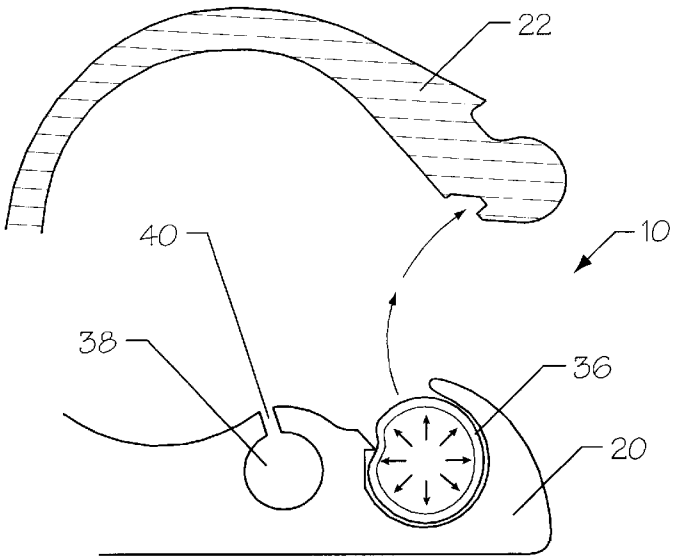
FIG. 6 is a sectional view illustrating the flotation device of FIG. 3 with the inflatable tubing being completely inflated and one side of the cover moving away from the carrier.
Figure 3:
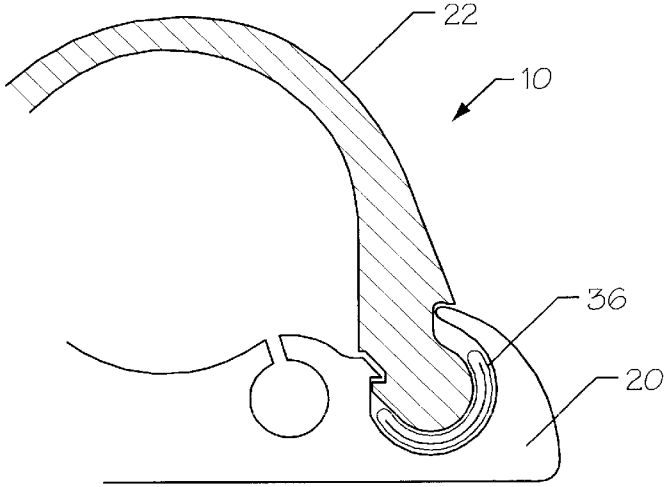
FIG. 3 is a sectional view illustrating an embodiment of the flotation device, constructed in accordance with the present invention, with an inflatable tubing positioned between the cover and the carrier.
Figure 5:
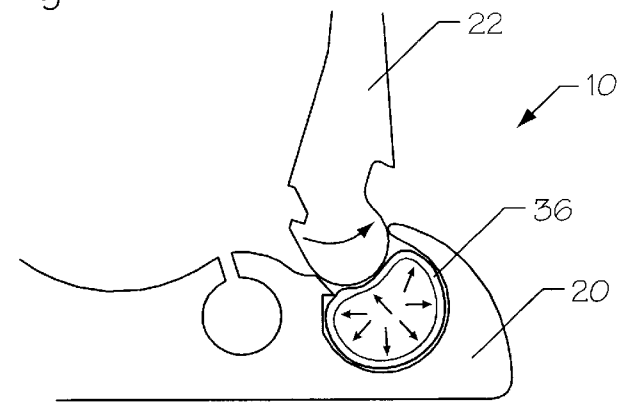
FIG. 5 is a sectional view illustrating the flotation device of FIG. 3 with the inflatable tubing being substantially inflated.

As illustrated in FIG. 1 a flotation device, indicated generally at 10, is mounted to a watercraft 12 and automatically activates to maintain the watercraft in a floating condition. The flotation device 10 includes a mounting plate 14 preferably mounted on the exterior of the hull 16 of the watercraft 12. The mounting plate 14 and the cover 22 is the only portion of the flotation device 10 that is visible on the exterior of the watercraft 12. It is considered important that the mounting plate 14 have low profile and an unobtrusive visual presence, so that the mounting plate 14 does not significantly affect either the aerodynamic or visual lines of the watercraft 12 when not inflated. As illustrated in FIG. 2, the mounting plate 14 is mounted at approximately the water line 18 on the hull 16 of the watercraft 12.

As illustrated in FIGS. 3–10, the mounting plate 14 has a carrier 20, a cover 22, and a deflated flotation bladder 24. The mounting plate 14 is preferably made from aluminum or similar material although constructing the mounting plate 14 from different types of material is within the scope of the present invention.

The flotation bladder 24 is folded to fit inside a space 26 formed between the carrier 20 and the cover 22. Preferably, the flotation bladder 24 is rolled into a spiral configuration. Furthermore, preferably, the flotation bladder 24 is made from urethane coated ballistic nylon although constructing the flotation bladder 24 from different types of material is within the scope of the present invention.

Figure 23:
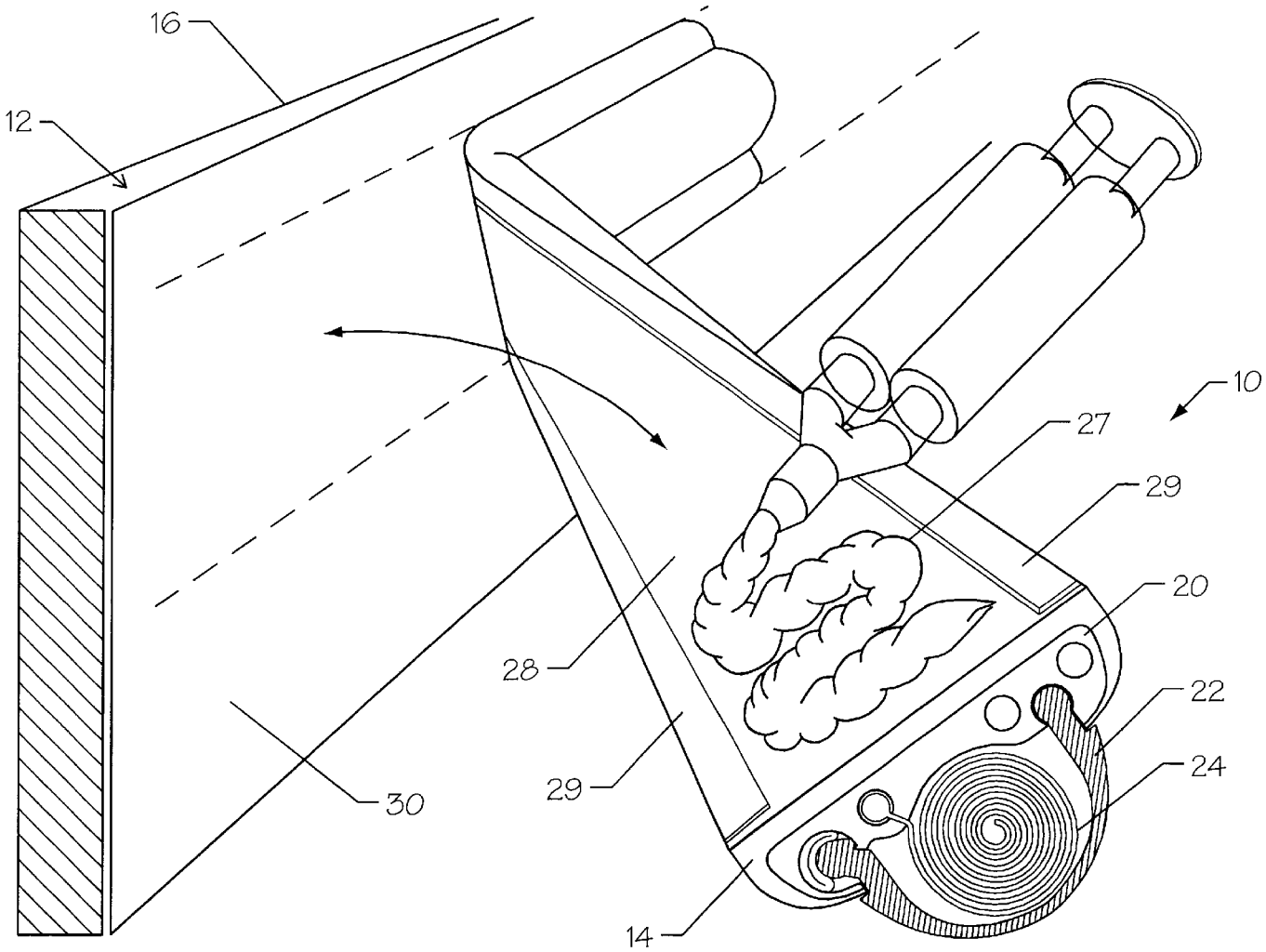
FIG. 23 is a perspective view illustrating the mounting of the flotation device to a watercraft.

The mounting plate 14 has a flat mounting surface 28 on one side which mounts directly to an attachment surface 30 of the hull 16 of the watercraft 12, as illustrated in FIG. 23. Preferably, the mounting plate 14 is mounted to the exterior of the watercraft hull 16 using either an adhesive for fiberglass and for metal hulls or screws for wood hulls (not shown). The preferred type of adhesive is a two-part epoxy 27. At least one strip 29 is positioned on the mounting plate 14 which maintains the mounting plate 14 to the hull 16 of the watercraft 12 while the two-part epoxy cures. The preferred brand of epoxy is DP 190, manufactured by Minnesota Mining and Manufacturing (3M), St. Paul, Minn. Screws (not shown) may be necessary on wooden hulled boats since some adhesive only sticks to the outermost layer of paint on the exterior of the hull 16.

The carrier 20 slides into and snaps into place within the mounting plate 14. The carrier 20 has two channels 32, 34 spaced apart from each other and extending axially along the length of the carrier 20. Placed in at least one of the channels 32, 34 is a flexible cover tubing 36. The cover tubing 36 is made from a flexible material so that the cover tubing 36 can be collapsed against itself When the cover tubing 36 is expanded it substantially fills the channels 32 and/or 34.

A bladder retaining slot 38 extends axially along the carrier 20 between the channels 32 and 34. The bladder retaining slot 38 has a narrowed neck 40 at the top if the bladder retaining slot 38. In the preferred embodiment, the bladder retaining slot 38 is substantially circular and about ½ inch in diameter. The bladder retaining slot 38 can have a larger diameter for retaining larger bladders required for heavier watercraft.

Figure 7:
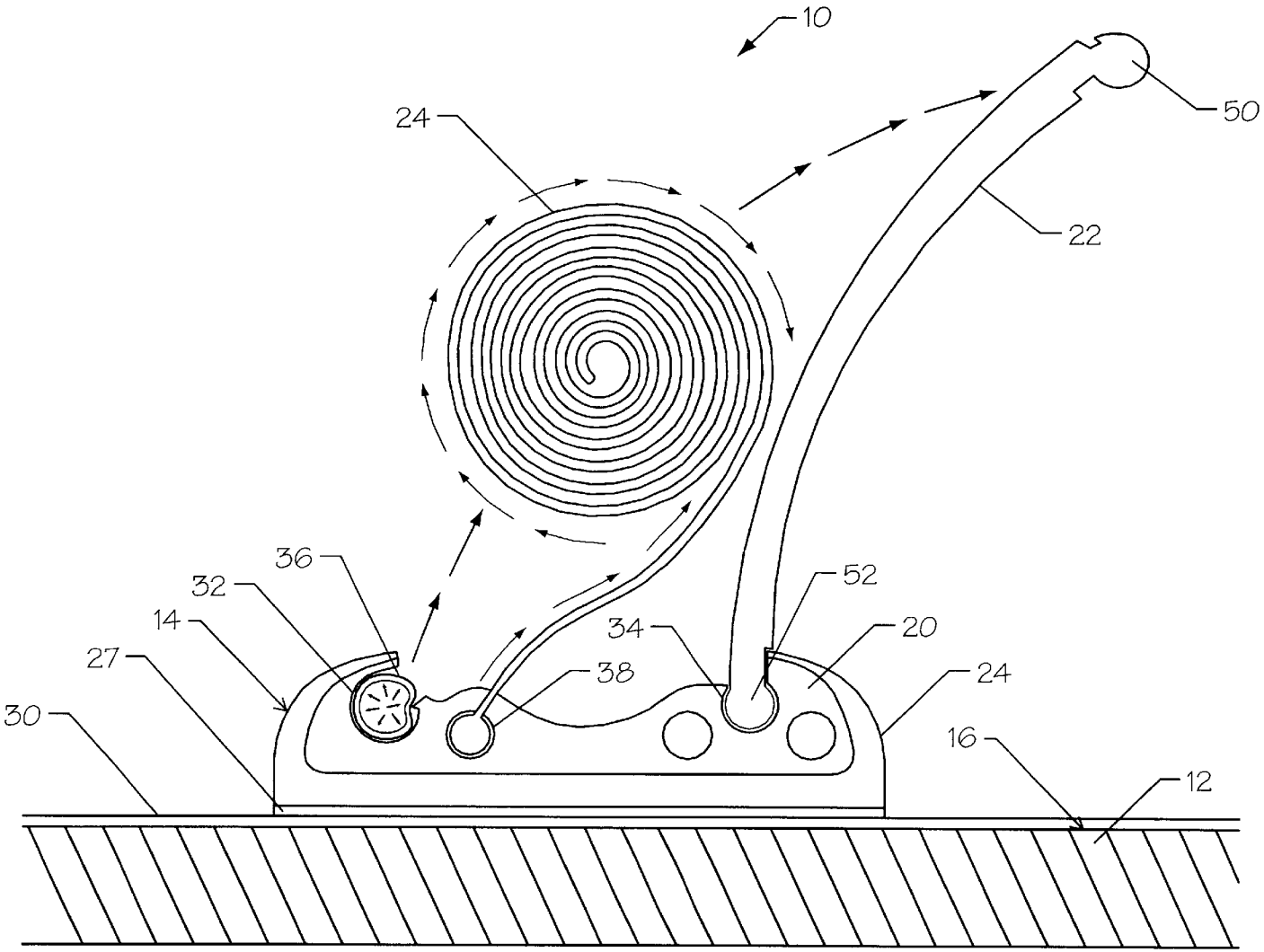
FIG. 7 is a sectional view illustrating the flotation device of FIG. 3 with the inflatable tubing being completely inflated and the flotation bladder being stored in spiral condition.
Figure 8:
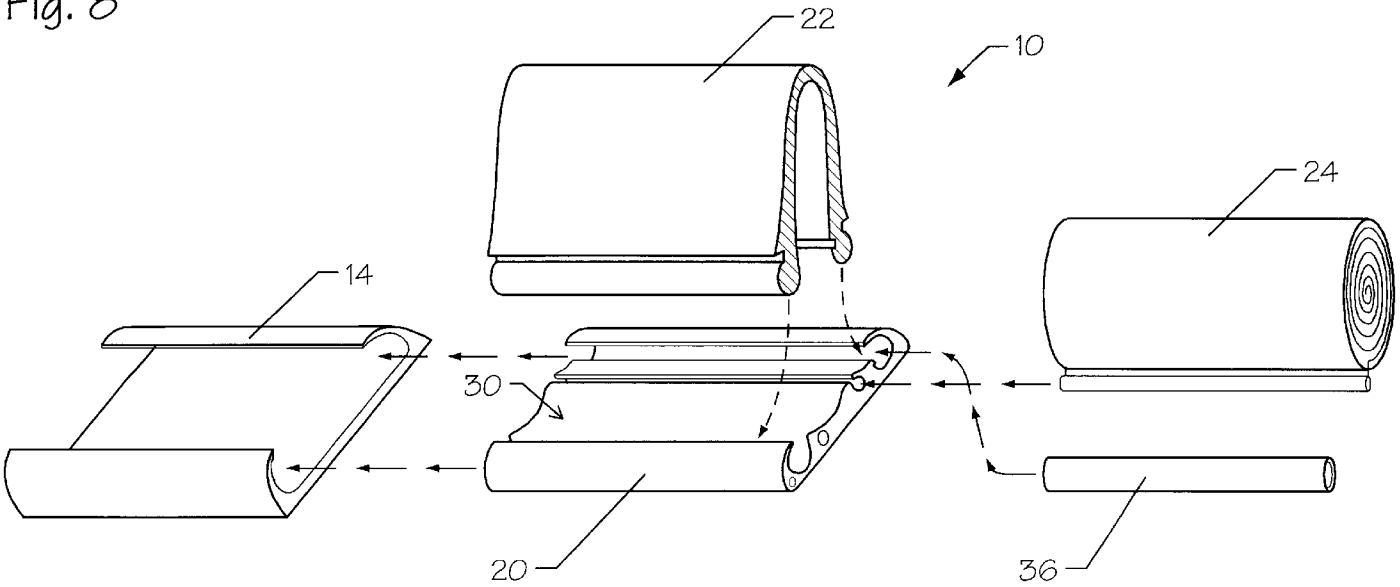
FIG. 8 is an exploded assembly view illustrating the flotation device of FIG. 3.
Figure 9:
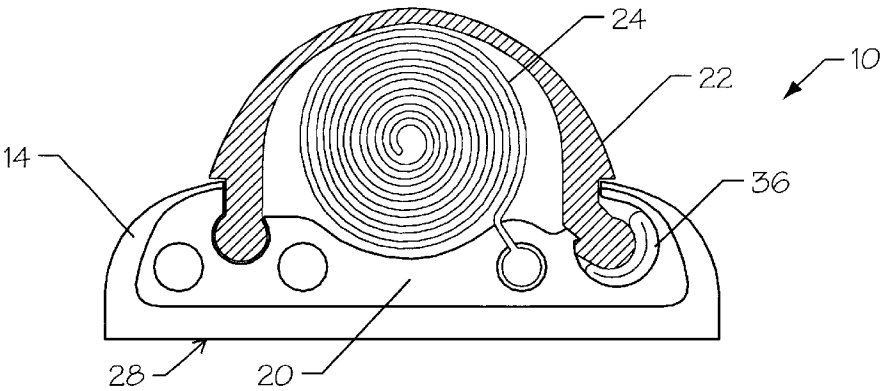
FIG. 9 is a sectional view illustrating the flotation device of FIG. 8 in a completely assembled condition.

The flotation bladder 24 has one side 42 with an enlarged edge 44 along the length of the flotation bladder 24 as shown in FIG. 12 and in cross section in FIG. 14. The enlarged edge 42 has a rod or rope which fits inside the bladder retaining slot 38 and is held in place by the neck 40 as shown in FIG. 7. The enlarged edge 44 and the rod are slid along the bladder retaining slot 38, attaching the flotation bladder 24 to the carrier 20.

The cover 22 has an interior surface 46, an exterior surface 48, and two hooked edges 50, 52 extending axially along the length of the cover 22. The hooked edges 50, 52 are shaped to fit in the channels 32, 34 on the carrier 20 over the flattened tubing 36, as shown in FIGS. 3–8. The cover 22 is attached to the carrier 20 by sliding the hooked edges 50, 52 in to the channels 32, 34 over the cover tubing 36 is attached at one end to a supply tubing 54 which is attached to a gas supply 56. The gas supply 56 preferably contains an inert, compressed gas such as $CO_2$.

The cover 22 must be made from a durable material as it is going to be exposed to the elements continuously. The cover 22 is preferably made from thermoplastic rubber. When the mounting plate 14 is mounted on the hull 16 of the watercraft 12 and the cover 22 is in place, the present invention functions as a bumper to protect the watercraft 12.

When the cover 22 is to be removed so that the bladder 24 can be inflated, compressed gas is released from the gas supply 56 and flows through the supply tubing 54 to the cover tubing 36. As illustrated in FIGS. 3–6, the cover tubing 36 expands, filling the channel 32, and removing one side of the cover 22 from the carrier 20. The cover 22 remains connected to the carrier 20 in the other channel 32 and swings out of the way of expanding flotation bladder 24.

Figure 15:
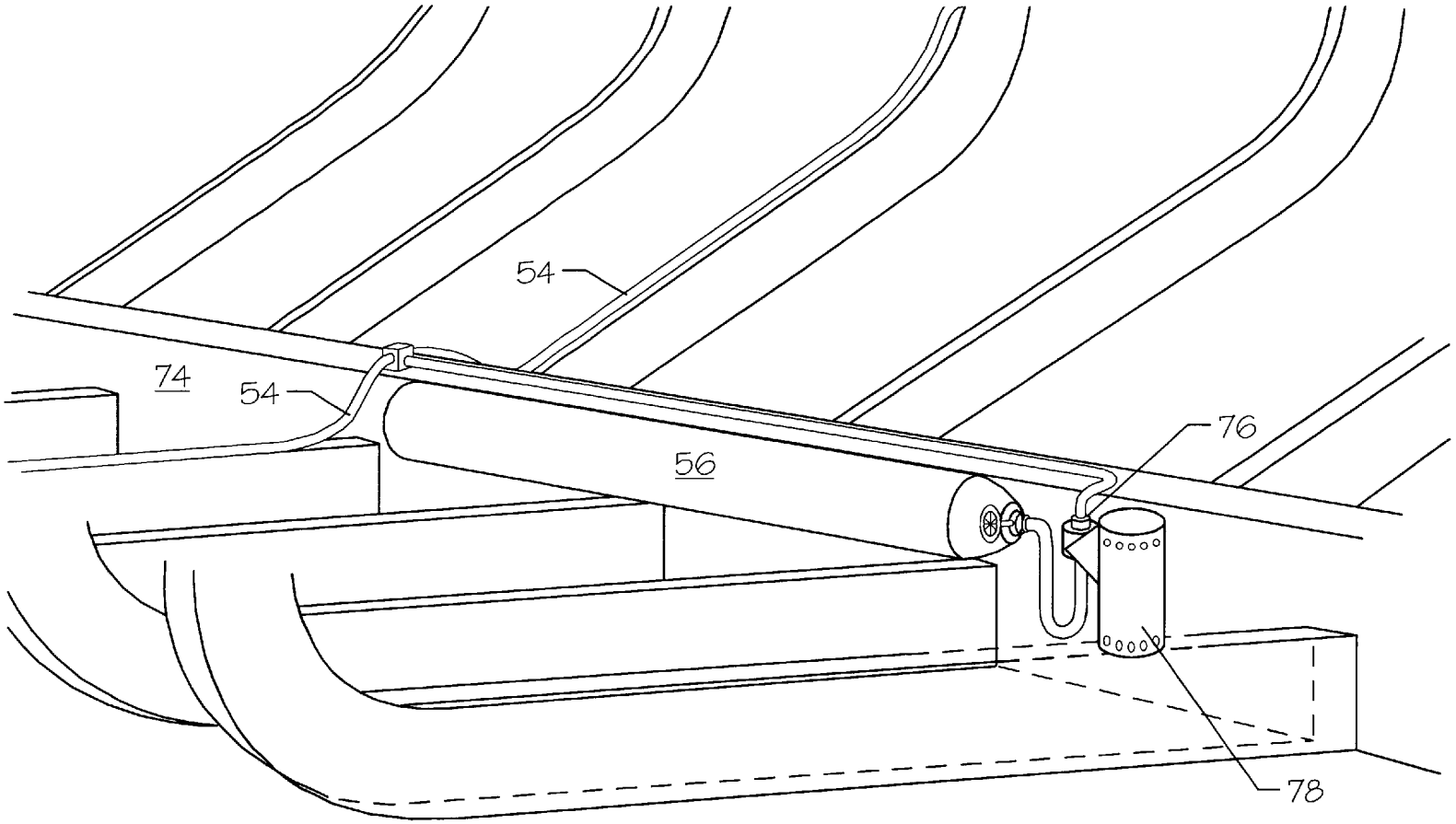
FIG. 15 is a perspective view illustrating the float switch activation assembly, constructed in accordance with the present invention, with the float switch activation assembly and a compressed gas cylinder mounted to the hull of the watercraft and connected to the rail with tubing.

Referring next to FIG. 15, at the opposing end from the attachment to the supply tubing 54, the cover tubing 36 is attached to the bladder fill tubing 58. The bladder fill tubing 58 attaches to each flotation bladder 24 via a one-way flow valve (not shown). Such one-way valves are known in the art and are, therefore, not described in detail. After the cover tubing 32 has inflated, removing one side of the cover 22, the inert gas will flow in the inflation bladders 24, inflating the inflation bladders 24.

Figure 10:
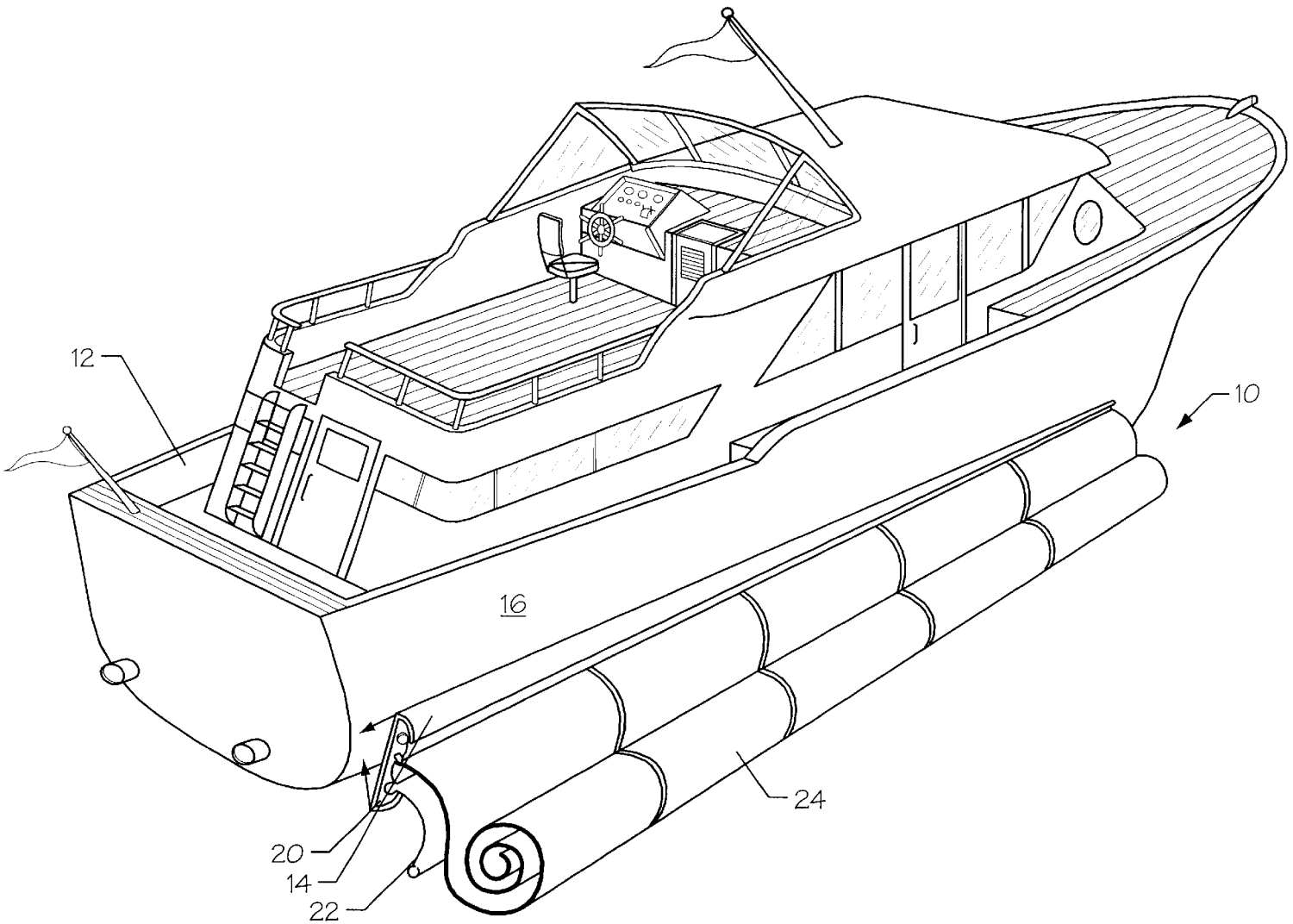
FIG. 10 is a perspective view illustrating the flotation device of FIG. 3, constructed in accordance with the present invention, with the flotation bladder of the flotation device starting to inflate.
Figure 11:
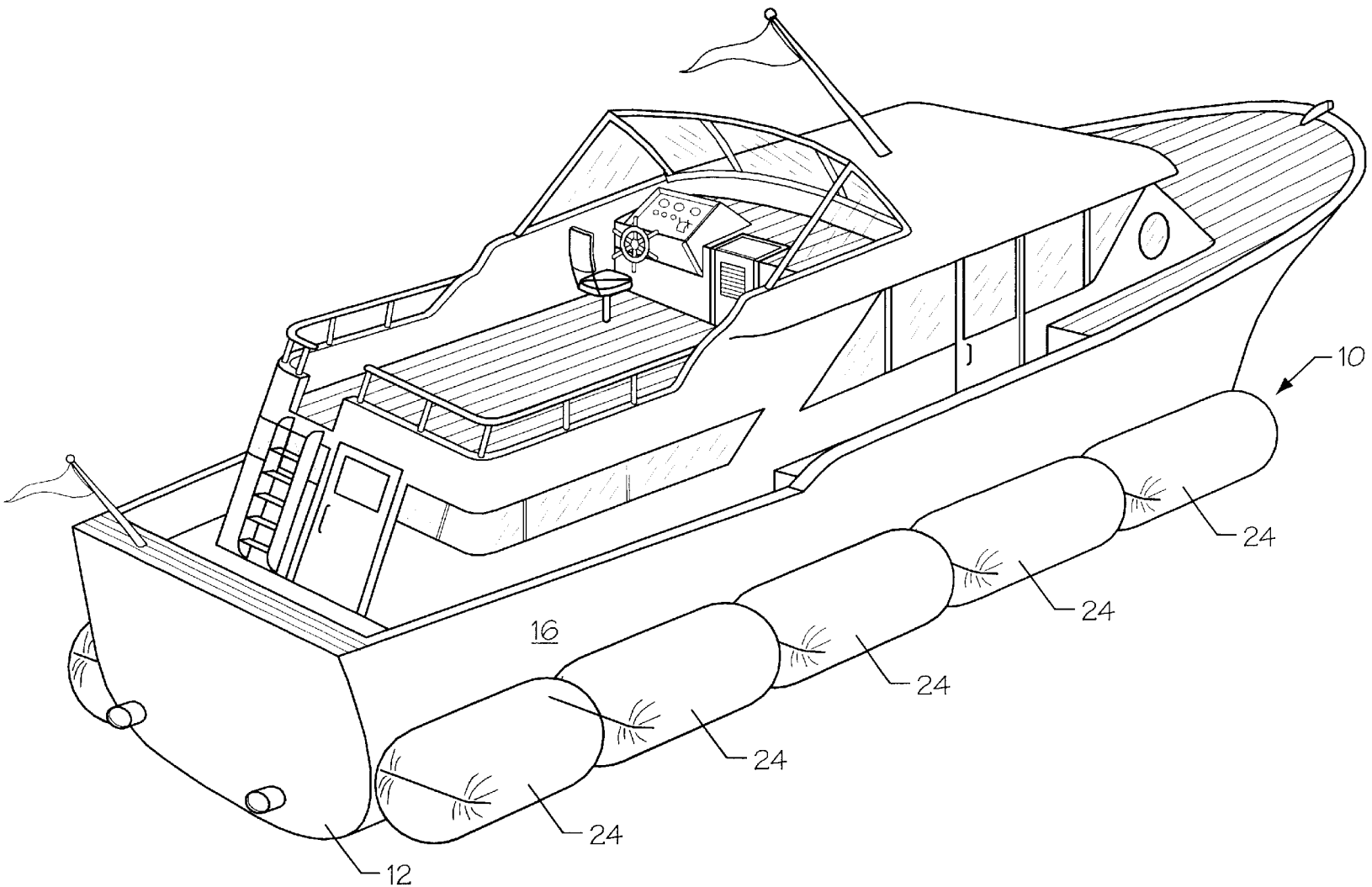
FIG. 11 is a perspective view illustrating the flotation device mounted on the watercraft with the flotation bladders being fully inflated.

FIGS. 10 and 11 illustrates a watercraft 12 with the preferred embodiment of the flotation bladders 24 mounted to the exterior of the hull 16. The flotation bladders 24 are fully inflated. The preferred embodiment of the flotation bladders 24 are single bladders that are each a given length and are attached to carrier 20 individually. FIG. 13 illustrates a fully inflated individual flotation bladder 24.

Either type of the flotation bladder 24 can be used with any of the embodiments of the flotation device 10. The plurality of inflation bladders 24 are the preferred embodiment because it is easier to manufacture and makes the flotation device 10 easier to mount on a variety of watercraft. The flotation bladders 24 are manufactured in a given length and the needed numbers of bladders are put along the length of the hull 16.

The carrier 20 of each embodiment is made from a semi-rigid material, such as UHMW plastic. The material must be flexible enough to allow the carrier 20 to bend to match the curve of the watercraft hull 16. However, the material must to be rigid enough so that the inflation of the flotation bladder 24 will not dislodge the enlarged edge 44 from bladder retaining slot 38.

The cover 22 must be made from a durable material including, but not limited to, thermal plastic rubber, as it is going to be exposed to the elements continuously. When the carrier 20 is mounted on the hull 16 of the watercraft 12 and the cover 22 is in place, the present invention functions as a bumper to protect the watercraft 12.

Figure 16:
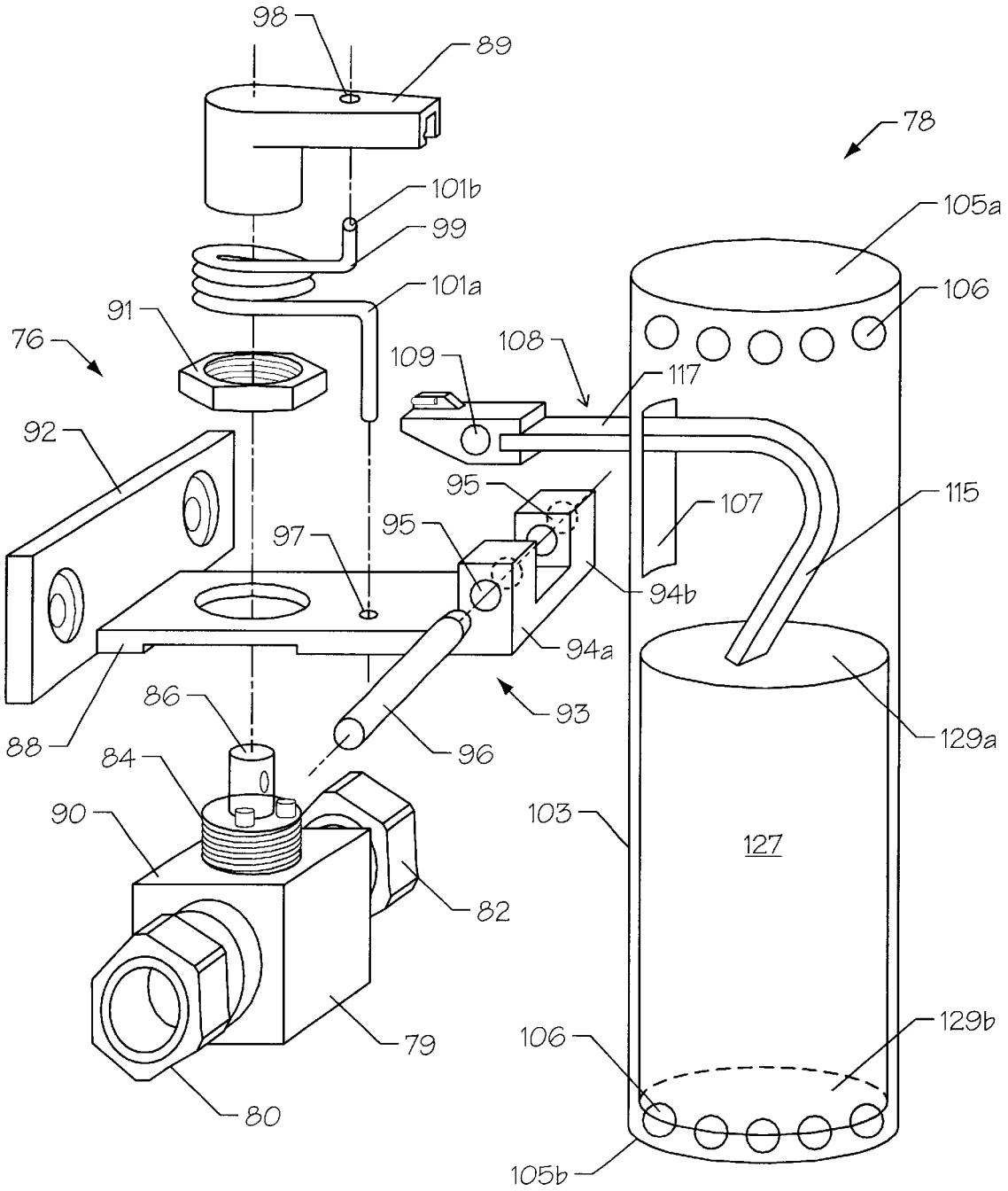
FIG. 16 is an exploded view illustrating an embodiment of the float switch activation assembly, constructed in accordance with the present invention.

As illustrated in FIG. 16, the present invention is a float switch activation assembly, indicated generally at 78. It should be noted that while the float switch activation assembly 78 of the present invention has been and will be described as capable of inflating the flotation device 10 on a watercraft 12, a person skilled in the art will understand that the float switch activation assembly 78 of the present invention can be used in any situation to activate a gas or fluid supply 56 or to activate an electrical switch or chemical process. The float switch activation assembly 78 is not limited to use only on a flotation device 10 on a watercraft 12.

Figure 24:
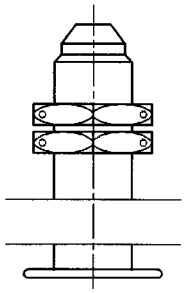
FIG. 24 is a side elevational view illustrating the bulkhead fitting for connecting the flotation device with the gas supply.
Figure 25:
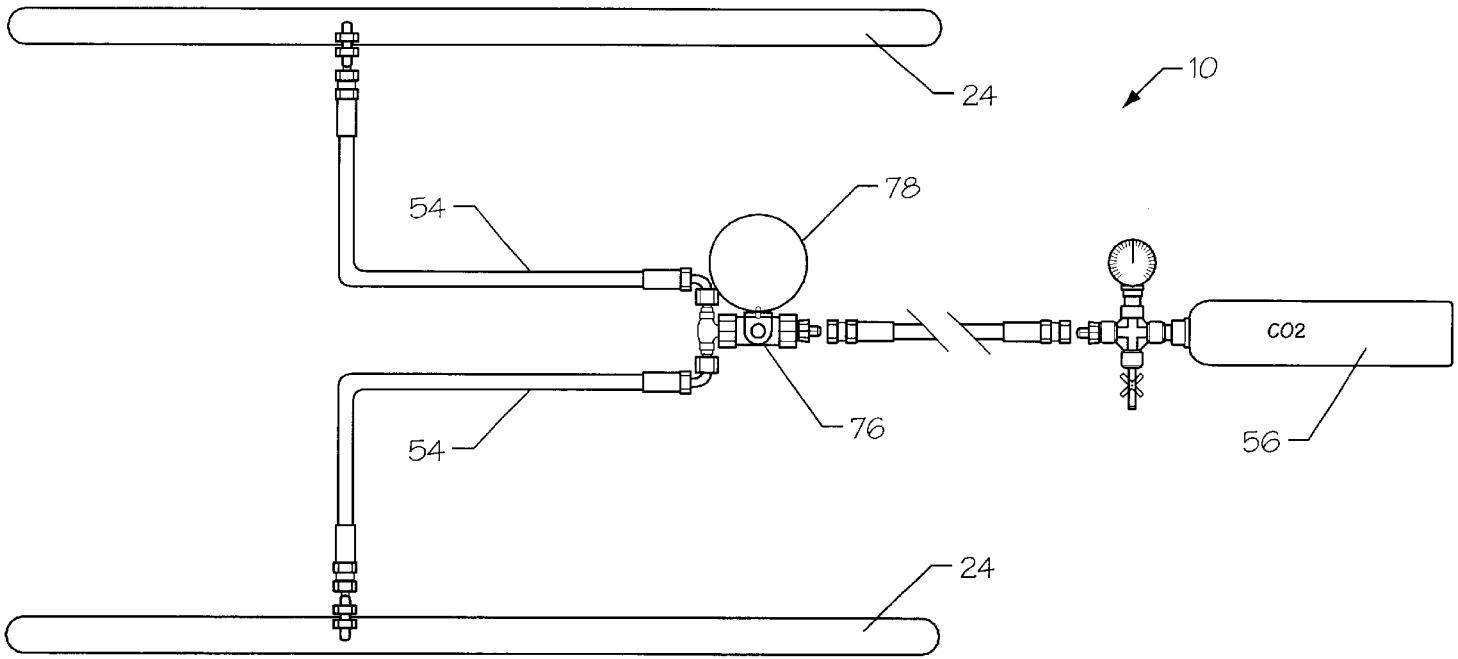
FIG. 25 is a plan view illustrating the connection between the gas supply, the float switch activation assembly, and the flotation device.

The float switch activation assembly 78 is mounted on the mounted on the inside 74 of the hull 16 of the watercraft 12 and is connected to a gas supply 56. The gas supply 56 is attached to the supply tubing 54 via a valve 76 which is activated by the float switch activation assembly 78. The supply tubing 54 and all fittings are made from stainless steel or silicone rubber tubing. In the preferred embodiment, the supply tubing 54 is drawn seamless hydraulic line tubing, 0.375" I.D. A watertight bulkhead connection, as illustrated in FIGS. 24 and 25. will penetrate through the boat hull in two 2) places to route the supply tubing 54 from the inside of the hull 16 out to a connection to the cover tubing 36 and the flotation bladders 24. The float switch activation assembly 78, in the preferred embodiments, is located on the side of the hull 16 at a height h1 selected so that the float switch activation assembly 78 actuates when the hull 16 is filled with enough water to lower the watercraft 12 about two (2") inches below the designed waterline for that particular watercraft 12. The float switch activation assembly 78 preferably activates when the float 127 rises approximately two (2") inches within the float body 103.

A partially exploded view of the valve 76 and the float switch activation assembly 78 is illustrated in FIG. 16. The valve body 79 is a standard stainless steel ball valve and in the preferred embodiment the valve body 79 is manufactured by the Nupro Corporation. The valve body 79 has an inlet 80, an outlet 82, a threaded attachment post 84, and a valve stem 86 which controls if the valve 76 is open or closed. An attachment plate 88 is threaded down over the attachment post 84 to rest on the top 90 of the valve body 79. A nut 91 secures the attachment plate 88 to the valve body 79 by threading on to the attachment post 84.

The attachment plate 88 has a mounting plate 92 attached to one end to allow the valve 76 to be mounted to the boat hull 16. Also part of the attachment plate 88 is a pivot mount 93. In the preferred embodiment, the pivot mount 93 is formed of two holders 94*a*, 94*b* with pivot holes 95*a*, 95*b*, respectively. A pivot rod 96 slides into pivot hole 95*a*, 95*b*. A retaining hole 97 is provided in the attachment plate 88.

A handle 89 attaches to the valve stem 86 and has a hole 98. A spring 99 fits around the base of the handle 89; and the ends 101*a*, 101*b* of the spring fit in holes 97 and 98, respectively. The spring 99 holds the handle 89 and the attached valve stem 86 in the open position, so that the valve 76 is biased open as shown in FIG. 16.

Figure 17:
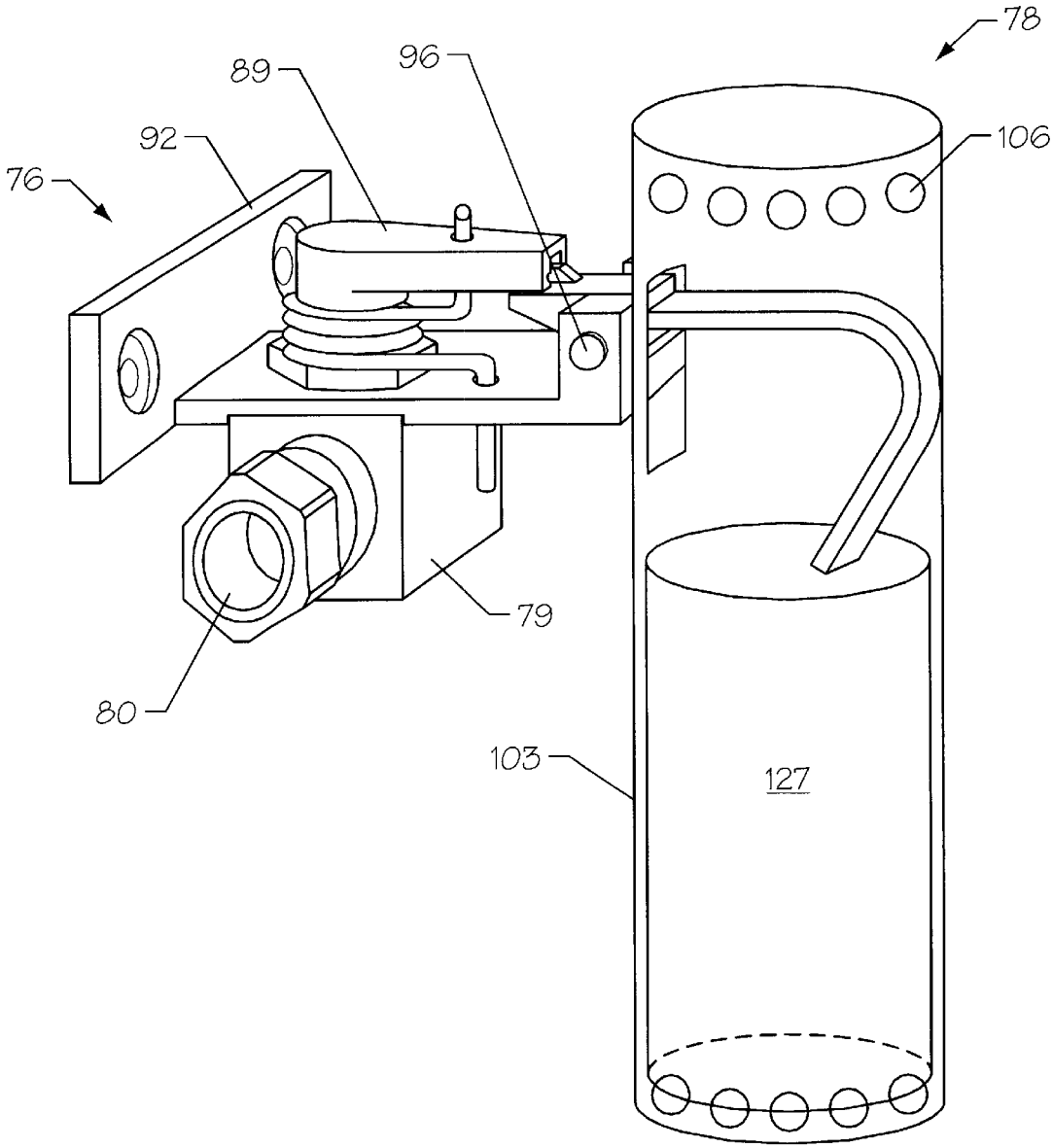
FIG. 17 is a perspective view illustrating the float switch activation assembly of FIG. 16 in the off position.

As shown in FIG. 17, the float switch activation assembly 78 is releasably attached to the handle 89 to hold the valve 76 in the closed position. The float switch activation assembly 78 has a body 103. The body 103 is a hollow shell having a top and bottom end 105*a*, 105*b*, respectively, which are closed. Water flow holes 106 are placed around both ends to allow water to flow freely in and out of the body 103.

On one side the body 103 has a hole 107. A float arm 108 extends through the hole 107 from inside the body 103 to the outside. The float arm 108 is pivotally attached at pivot point 109 to the pivot mount 93 with pivot rod 96. The float arm 108 has a trigger end 115 has a generally L shaped appearance. The L-shaped bend of the trigger is designed to center the interface between the arm and the float and provide better mechanical advantage for the float to release the trigger.

Figure 20:
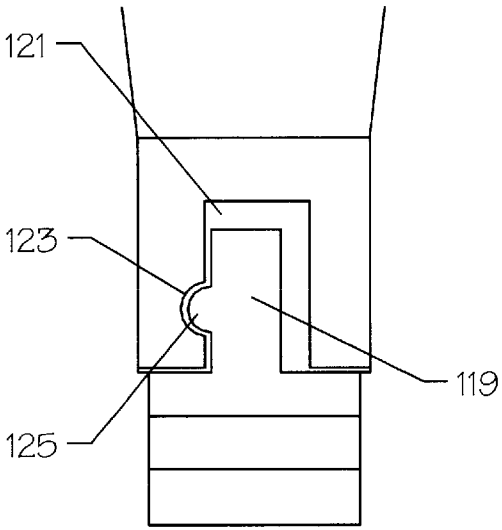
FIG. 20 is sectional view illustrating the interlock.
Figure 19:
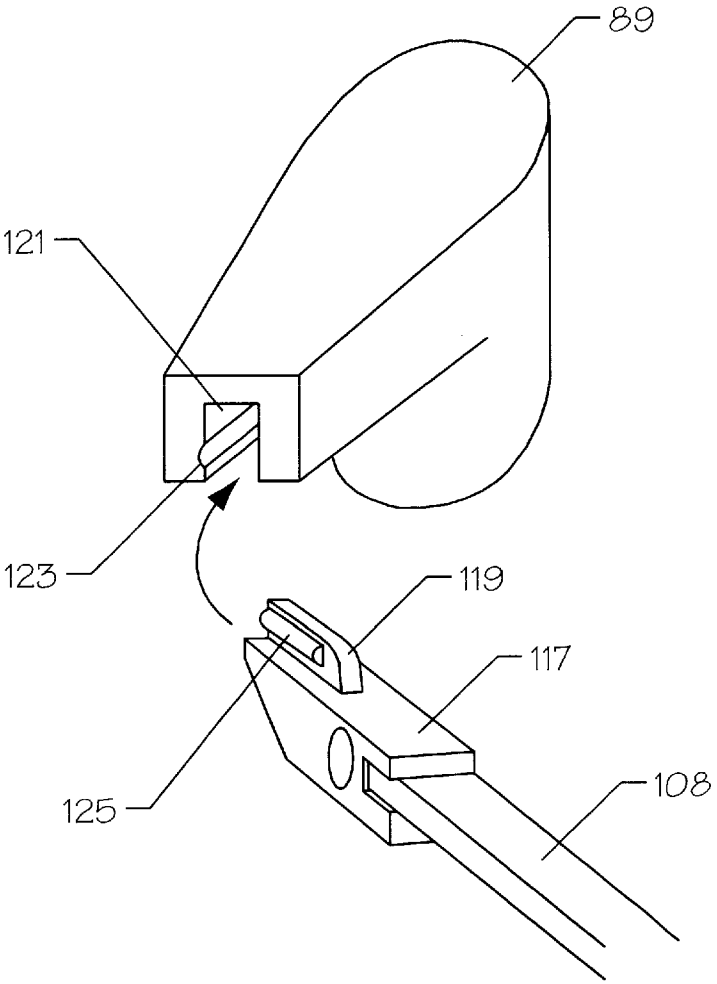
FIG. 19 is a perspective view illustrating float switch activation assembly with the interlock between the float switch and the valve switch.

As shown in FIG. 19, the attachment end 17 has a blade 119 which fits inside a channel 121 inside the handle 89. The channel 121 has a safety groove 123 running along one side. A bead 125 on the blade 119 fits into the safety groove 123 as shown in cross-section in FIG. 20. This blade 119 and the bead 125 form a releasable attachment between the handle 89 and the float arm 108 when the float arm 108 is attached to the handle 89 biasing the valve 76 open, as shown in FIG. 17.

Figure 18:
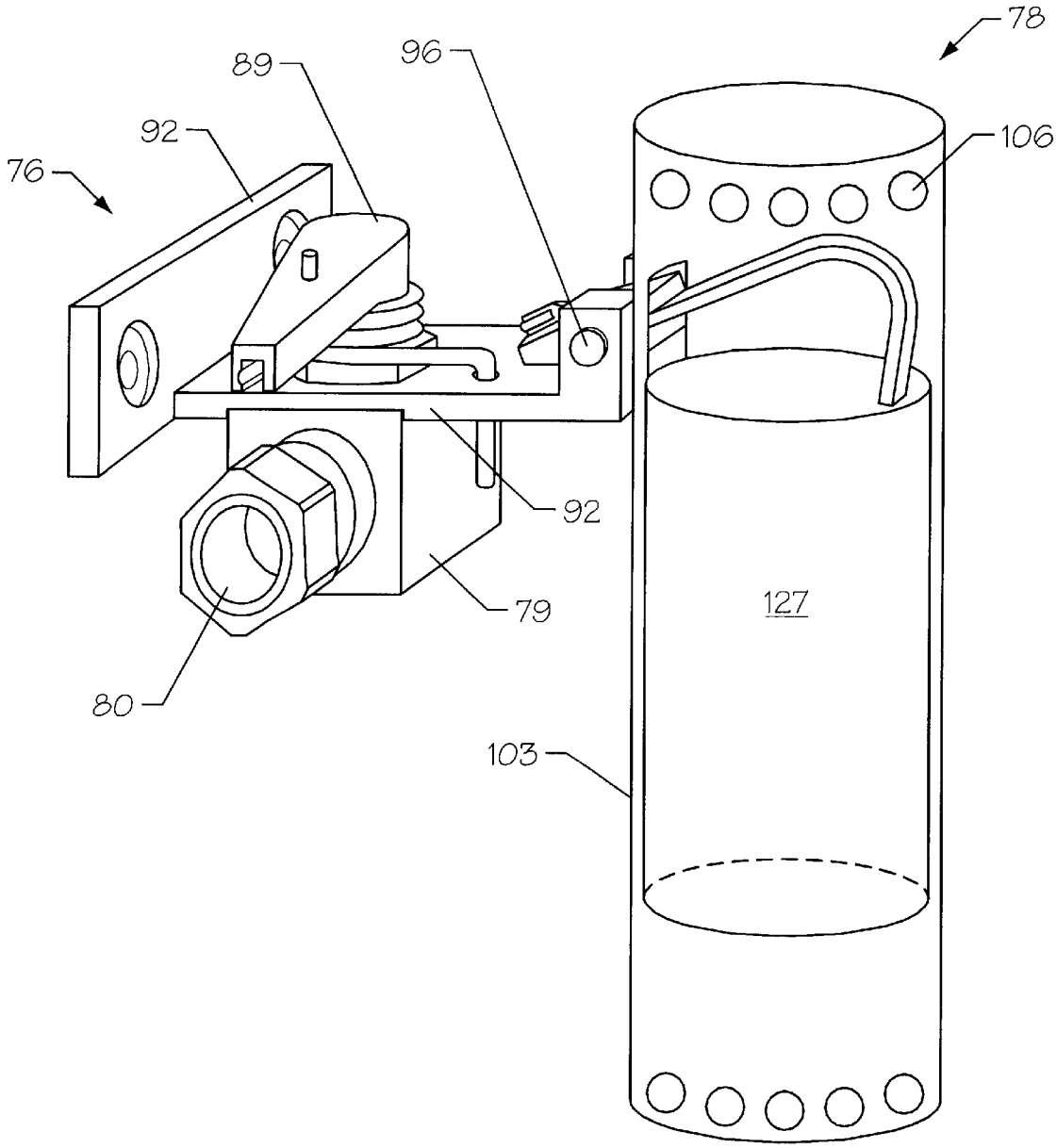
FIG. 18 is a perspective view illustrating the float switch activation assembly in the on position.

The placement of the pivot point 109 close to the attachment end 117 means that with no support of the float arm 108, the attachment end 117 pivots up against the handle 89, pressing the blade 119 firmly up in to the groove channel. To release the handle 89 and trigger the spring 99 to bias the valve 76 open, the float arm 108 must be pivoted so that the blade 119 pulls down out of the channel 121, releasing the handle 89. The bead 125 and the safety groove 123 are a safety mechanism to insure that vibration alone will not set off the trigger mechanism. When the handle 89 is in the closed position as shown in FIG. 18 this is the safe mode for the valve.

The trigger end 115 rests on a top 129*a* of a float 127. The float 127 is preferably made from closed cell polystyrene in the preferred embodiment. The float 127 is sized to snugly fit inside the body 103 so that it will not move up and down inside the body from gravity alone. The float 127 nominally requires at least one pound of force to move although setting the float 127 to another predetermined amount of force is within the scope of the present invention. The bottom end 129*b* of the float 127 is set so that it is just above the line of water flow holes 106 on the bottom edge of the body 103 in the safe mode.

If a rupture of the hull occurs then water will start to fill the inside of the hull 16. As the water reaches the base of the float switch 78, the water will flow into the flow holes 106. The water will cause the float 127 to rise inside the body 103. The float 127 is fit inside the body 103 tight enough that only the continuous presence of water will provide enough force for the float 127 to rise. Water splashing into the holes 106 due to rough seas will not cause the float 127 to rise. As the float 127 rises it pushes the trigger end 115 of the float arm 108 upward, causing the attachment end 117 downward as shown in FIG. 18. This pulls the blade 119 out of the channel 121 and releases the compressed gas to fill the cover tubing 36 and then the flotation bladder 24 is inflated through a check valve (not shown). The deflated bladder 24 can then be removed by pulling the enlarged edge 44 of the flotation bladder 24 along the bladder retaining slot 38 to the end of the carrier 20. Then the flotation bladder 24 can be re-rolled and replace or a new flotation bladder 24 can be re-mounted in the bladder retaining slot 38 and the cover 22 replaced.

Figure 22:
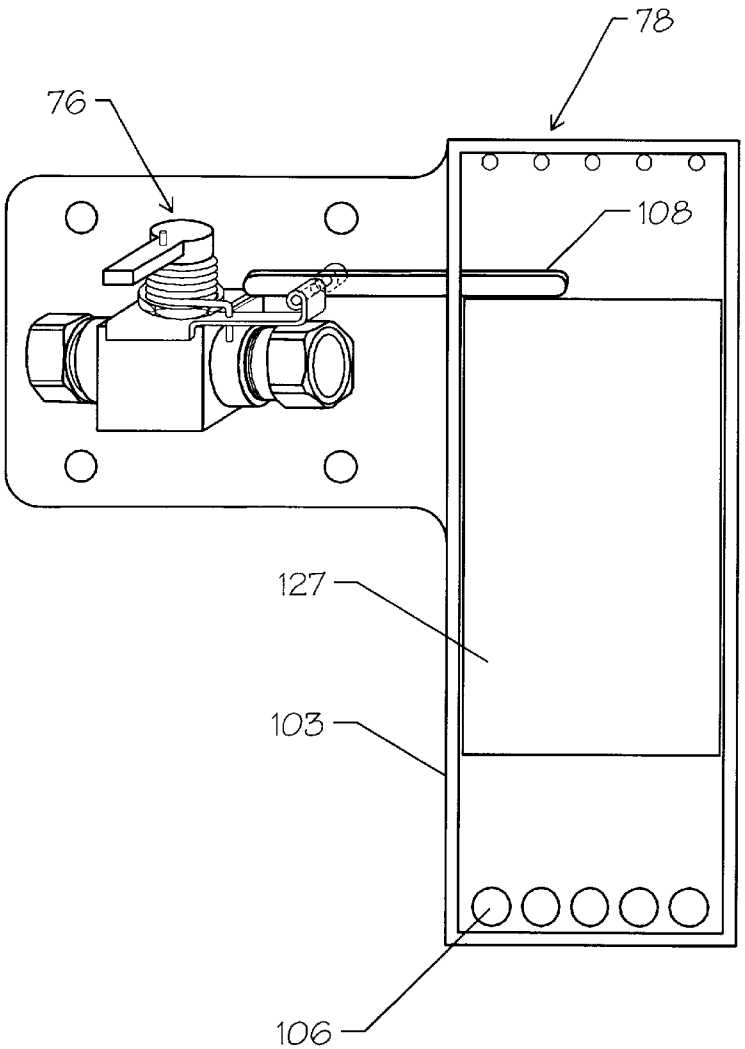
FIG. 22 is a side view illustrating the float switch activation assembly of FIG. 21, constructed in accordance with the present invention, with the float switch activation assembly being in the on position.
Figure 21:
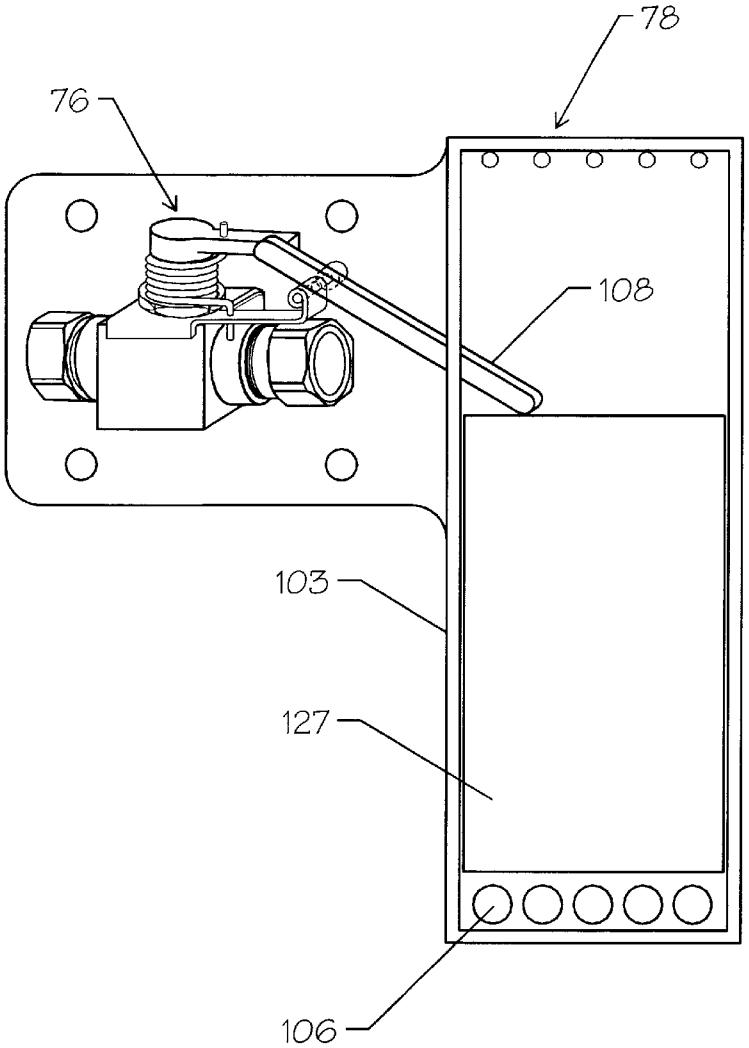
FIG. 21 is a side view illustrating another embodiment of the float switch activation assembly, constructed in accordance with the present invention, with the float switch activation assembly being in the off position.

As illustrated in FIGS. 21 and 22, another embodiment of the float switch activation assembly 78 is illustrated. The float 127 within the float switch activation assembly 78 moves upward upon a predetermined amount of water entering the float 127 through the water holes 106. The float 127 moves the float arum 108 to activate the valve 76 to begin inflation of the inflation bladder 24.

The present invention can also provide emergency notification device or other device based on the water level in the hull 16 of the watercraft 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A float switch assembly for activating a gas supply for inflating a flotation device mounted on a watercraft, the flotation device maintaining the watercraft in a floating condition, the float switch assembly comprising:

a hollow float housing having a first end and a second end;

at least one aperture formed in the first end of the float housing;

a float body movable within the float housing upon a predetermined amount of water entering the float housing through the aperture;

a trigger mechanism contacting the float body, the trigger mechanism having an attachment end extending through a slot formed in the float housing;

a pivot assembly pivotally connected to the attachment end of the trigger mechanism; and an activatable valve mechanism connected to the gas supply, the valve mechanism releasably connected to the attachment end of the trigger mechanism and movable from a closed position to an open position;

wherein upon movement of the float body within the float housing, the trigger mechanism pivots about the pivot assembly thereby disconnecting the attachment end of the trigger mechanism from the valve mechanism and moving the valve mechanism into the open position such that gas flows from the gas supply to the flotation device.

2. The float switch assembly of claim 1 and further comprising:

at least one aperture formed in the second end of the float housing.

3. The float switch assembly of claim 1 wherein the hollow float housing is substantially cylindrical having a closed first end and a closed second end.

4. The float switch assembly of claim 1 wherein the float body is substantially cylindrical having a closed first end and a closed second end.

5. The float switch assembly of claim 1 wherein the valve mechanism has a rotatable handle, the handle receiving at least a portion of the attachment end of the trigger mechanism, the handle rotatable to move the valve mechanism from the closed position to the open position.

6. The float switch assembly of claim 5 wherein the attachment end of the trigger mechanism has a blade and the handle has a channel, the attachment end of the trigger mechanism receivable within the channel of the handle.

7. The float switch assembly of claim 6 wherein the blade has a bead and the channel has a safety groove, the bead of the blade receivable within the safety groove of the handle.

8. The float switch assembly of claim 6 and further comprising:

biasing means about the handle for biasing the valve mechanism into the open position upon removal of the blade from the channel.

9. A switch system for automatically activating mechanism such as a gas or fluid supply, an electrical switch, or chemical process, the switch system comprising:

a float housing;

a float slidable within the float housing, the float slidable from a first position to a second position;

an activation trigger extending through the float housing, the activation trigger having a first trigger end and a second trigger end, the first trigger end contacting the float; and a valve activating the gas supply, the valve connected to the second trigger end;

wherein upon movement of the float from the first position to the second position, the second trigger end activating the mechanism.

10. The switch system of claim 9 wherein the activation trigger is pivotally connected between the float housing and the valve.

11. The switch system of claim 9 wherein the float housing is substantially cylindrical having a closed first end and a closed second end, the closed first end having at least one aperture formed therein.

12. The switch assembly of claim 11 and further comprising:

at least one aperture formed in the closed second end of the float housing.

13. The switch assembly of claim 9 wherein the float is substantially cylindrical having a closed first end and a closed second end.

14. The switch assembly of claim 9 wherein the valve has a rotatable handle, the handle receiving at least a portion of the second trigger end, the handle rotatable to activate the valve to allow gas flow between the gas supply and the flotation device.

15. The switch assembly of claim 14 wherein the second trigger end of the activation trigger has a blade and the handle has a channel, the second trigger end of the activation trigger receivable within the channel of the handle.

16. The switch assembly of claim 15 wherein the blade has a bead and the channel has a safety groove, the bead of the blade receivable within the safety groove of the handle.

17. The switch assembly of claim 15 and further comprising:

biasing means about the handle for biasing the valve into an open gas flow position upon removal of the blade from the channel.

18. A method for activating a gas flow between a gas supply and a flotation device, the method comprising:

providing a hollow float housing;

positioning a float body within the float housing;

providing a valve mechanism between the gas supply and the flotation device;

pivotally connecting a trigger mechanism between the float body and the valve mechanism;

sliding the float body within the float housing upon the occurrence of a predetermined event;

pivotally rotating the trigger mechanism; and activating the gas flow between the gas supply and the flotation device.

19. The method of claim 18 and further comprising:

forming at least one aperture in the float body, the predetermined event being water entering the float body.

20. The method of claim 19 and further comprising:

raising the float body within the float housing;

pivoting the trigger mechanism; and activating the gas flow between the gas supply and the flotation device.

* * * * *